US008434959B2

(12) United States Patent
Bennett

(10) Patent No.: US 8,434,959 B2
(45) Date of Patent: May 7, 2013

(54) COSMETIC CONTAINER WITH MIRRORED ELEMENT

(76) Inventor: Kyle M. Bennett, Gouverneur, NY (US)

( * ) Notice: Subject to any disclaimer, the term of this patent is extended or adjusted under 35 U.S.C. 154(b) by 539 days.

(21) Appl. No.: 12/692,077

(22) Filed: Jan. 22, 2010

(65) Prior Publication Data

US 2010/0221059 A1 Sep. 2, 2010

Related U.S. Application Data

(60) Provisional application No. 61/146,606, filed on Jan. 22, 2009.

(51) Int. Cl.
*A45D 42/02* (2006.01)

(52) U.S. Cl.
USPC ..... 401/195; 132/291; 132/316

(58) Field of Classification Search ..... 132/291, 132/296, 301, 302, 304, 309, 316
See application file for complete search history.

(56) References Cited

U.S. PATENT DOCUMENTS

| | | | | |
|---|---|---|---|---|
| 892,246 | A | | 6/1908 | Gamber |
| 899,246 | A | | 6/1908 | Gamber |
| 1,485,172 | A | | 2/1924 | Dowell |
| 1,503,378 | A | | 7/1924 | Reid |
| 1,506,589 | A | | 8/1924 | Jaroslawski-Fioret |
| 1,525,665 | A | | 2/1925 | Slover et al. |
| 1,607,448 | A | | 11/1926 | Dykes |
| 1,754,981 | A | | 4/1930 | Coryell |
| 1,760,481 | A | | 5/1930 | Coryell |
| 1,875,127 | A | | 8/1932 | Parkin |
| 1,986,086 | A | * | 1/1935 | Weiss ..... 362/142 |
| 2,196,017 | A | | 4/1940 | Kane |
| 2,254,300 | A | | 9/1941 | Lessin |
| 2,264,300 | A | | 12/1941 | Davies |
| 2,294,212 | A | * | 8/1942 | Scharff ..... 132/316 |
| 2,294,656 | A | * | 9/1942 | Feib ..... 132/316 |
| 2,309,544 | A | * | 1/1943 | Scharff ..... 132/316 |
| 2,459,733 | A | * | 1/1949 | Macy ..... 132/316 |
| 3,809,102 | A | | 5/1974 | Ross |
| 3,942,540 | A | | 3/1976 | Gause |
| 4,339,104 | A | | 7/1982 | Weidman |
| 4,685,558 | A | | 8/1987 | Filiz et al. |
| 5,012,831 | A | | 5/1991 | Canela |
| 5,054,505 | A | | 10/1991 | Yuhara |
| 5,320,125 | A | | 6/1994 | Barnhart |
| 5,337,890 | A | | 8/1994 | Lai |

(Continued)

OTHER PUBLICATIONS

U.S. Patent and Trademark Office (ISA/US): International Search Report and the Written Opinion of the International Searching Authority, or the Declaration, Mar. 19, 2010; pp. 1-8; U.S. Patent and Trademark Office; U.S.

*Primary Examiner* — David Walczak
*Assistant Examiner* — Joshua Wiljanen
(74) *Attorney, Agent, or Firm* — Middleton Reutlinger; Chad D. Bruggeman; John F. Salazar

(57) ABSTRACT

A cosmetic container for retaining and dispensing a cosmetic material is provided. The cosmetic container includes a first portion including an applicator, a second portion releasably coupled to the first portion and configured to move between a first position in which the applicator is exposed and a second position in which the applicator is concealed and a mirrored element coupled to the first portion. The mirrored element is positionable behind the applicator when the second portion is moved to the first position to assist a user in applying the cosmetic material.

18 Claims, 13 Drawing Sheets

U.S. PATENT DOCUMENTS

| | | | | |
|---|---|---|---|---|
| 5,437,294 | A | 8/1995 | Ebbets, III et al. | |
| 5,513,754 | A | 5/1996 | Chang | |
| 5,735,298 | A | 4/1998 | Mayne et al. | |
| 5,819,764 | A | 10/1998 | Sussman | |
| 5,970,990 | A | 10/1999 | Dunton et al. | |
| 5,988,917 | A | 11/1999 | Sheffler et al. | |
| 6,305,861 | B1 * | 10/2001 | Gueret | 401/122 |
| 6,889,696 | B2 | 5/2005 | Thorpe et al. | |
| 6,997,321 | B2 | 2/2006 | Young | |
| 7,422,018 | B2 | 9/2008 | Dieudonat | |
| 2003/0154996 | A1 | 8/2003 | Bourjal | |
| 2004/0003825 | A1 | 1/2004 | Kelly | |
| 2005/0150513 | A1 | 7/2005 | Taylor | |
| 2006/0231116 | A1 | 10/2006 | Kaiser et al. | |
| 2008/0138138 | A1 | 6/2008 | Gueret | |
| 2008/0289645 | A1 | 11/2008 | Guillot | |
| 2009/0044827 | A1 | 2/2009 | Zilber et al. | |
| 2009/0229627 | A1 | 9/2009 | Golden et al. | |
| 2009/0308782 | A1 | 12/2009 | Grist | |
| 2009/0320874 | A1 | 12/2009 | Boye et al. | |
| 2010/0221059 | A1 | 9/2010 | Bennett | |
| 2010/0224212 | A1 | 9/2010 | Chen | |
| 2010/0288299 | A1 | 11/2010 | Won | |

* cited by examiner

COSMETIC CONTAINER WITH MIRRORED ELEMENT

CROSS REFERENCE TO RELATED APPLICATION

This application claims priority to and benefit under 35 U.S.C. §119(e) to U.S. Provisional App. No. 61/146,606, filed on Jan. 22, 2009, the entire contents of which are hereby incorporated by reference.

BACKGROUND OF THE INVENTION

The present disclosure relates generally to a container configured to hold and dispense a cosmetic material. More particularly, the present disclosure relates to a container configured to integrate a liquid cosmetic material and a mirrored element, i.e., a portable vanity.

A mirror is often used when applying a cosmetic material. A mirror helps a cosmetics user to ensure that the cosmetic material is applied to the proper location on their person and in the proper amount. A mirror also enables a user to identify and correct mistakes made while dispensing and/or applying cosmetic material. Typically, a user must locate an external mirror or carry a compact to ensure that cosmetic material is dispensed and/or applied properly. In any number of situations, it may be difficult for a user to locate an external mirror. Further, when using a compact, a user may be required to use both hands or juggle both the cosmetic container and the compact in one hand. These types of arrangement can make it difficult for a user to get a good view, i.e., a view that is stable, provides a clear view of the cosmetic material being applied, etc. Misapplications of the cosmetic material may result from not having a mirror and/or not having a good view. Such misapplications include, but are not limited to, applying the cosmetic material at the wrong location, poking ones' self in the eye with an applicator, etc.

Accordingly, there is a need for an improved container for dispensing and/or applying a cosmetic material. There is also a need for an improved container configured for a user move the container from an open position to a closed position with a single hand. There is further a need for an improved container configured for single-handed application of cosmetic material. There is further a need for an improved container with an integrated mirror that enables a user to apply cosmetic material at a very close range, making the user capable of more precise application. There is further a need for an improved container with an integrated mirror, wherein the mirror is capable of being selectively positioned by the user and the mirror is capable remaining in the selected position during while user dispenses and/or applies the cosmetic material. There is further a need for an improved container that is convenient, ergonomic, and transportable.

SUMMARY OF THE INVENTION

On embodiment relates to a cosmetic container for retaining and dispensing a cosmetic material. The cosmetic container includes a first portion including an applicator, a second portion releasably coupled to the first portion and configured to move between a first position in which the applicator is exposed and a second position in which the applicator is concealed and a mirrored element coupled to the first portion. The mirrored element is positionable behind the applicator when the second portion is moved to the first position to assist a user in applying the cosmetic material.

DETAILED DESCRIPTION OF THE PREFERRED EMBODIMENTS

Referring generally to the FIGURES, a container 100 and components thereof are shown according to an exemplary embodiment. Container 100 is configured to retain and selectively dispense a liquid material. For purposes of the present disclosure, the term "liquid material" is used broadly to refer to any non-solid substance including, but not limited to, a gel, semi-liquid or semi-solid. The term liquid material is intended to cover substances including those with a relatively high viscosity (e.g., gels, etc.), those with a relatively low viscosity (e.g., water, etc.) and anything in between. The liquid material may be substantially homogeneous, or may have particles, including solid particles, suspended or otherwise contained therein.

Container 100 may be a cosmetic container or case for holding a liquid cosmetic material (e.g., lip gloss, eye liner, mascara, nail polish, cover-up, foundation, or other beauty aid, etc.). For purposes of the present disclosure, the term "cosmetic material" is used broadly to refer to any material which can be applied topically to the skin or other area on the user. Such materials include, but are not limited to, materials designed alter, conceal or enhance appearance or odor of the user and materials that provide a topical (e.g., skin, etc.) treatment or protection for the user. According to the various alternative embodiments, container 100 may also be used in any of a variety of non-cosmetic applications (e.g., as a writing utensil, a painter applicator, an adhesive dispenser, etc.).

According to an exemplary embodiment, container 100 is configured to integrate a liquid cosmetic material and a mirrored element. Container 100 allows for single handed application of a cosmetic material by a user. The mirrored element eliminates the need for an external mirror, i.e., a bathroom vanity mirror, car mirror, separate compact, etc. Additionally, the integrated mirror enables the user to apply cosmetic material at very close range for improved visibility, making the user capable of more precise application. Container 100 is thus convenient and easily portable, allowing for ergonomic cosmetic material application wherever and whenever the user desires.

Figure 1:
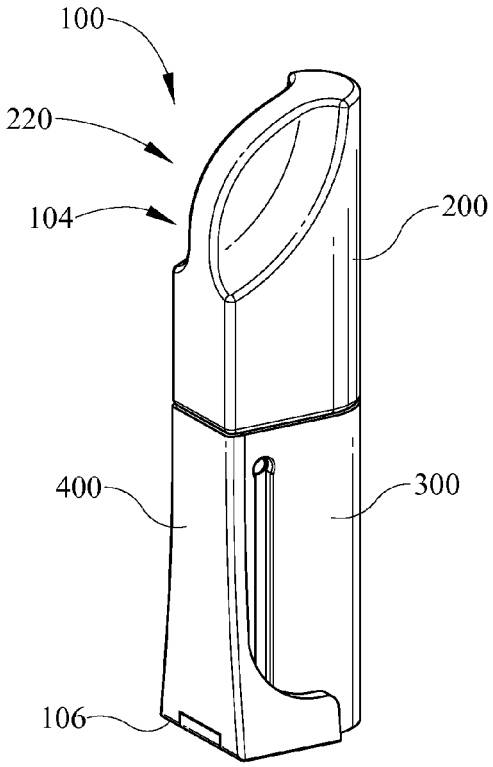
FIG. 1 is a perspective view of an exemplary embodiment of a container in a closed position.

Referring to FIG. 1, a first exemplary embodiment of container 100 is shown in a closed or stowed position. Container 100 generally includes a receptacle 200, an applicator 300, and a mirrored element 400. Receptacle 200, applicator 300, and mirrored element 400 cooperate to provide a conveniently sized storage system suitable for retaining, dispensing and/or applying liquid material. Container 100 may be provided in any of a number of shapes. According to an exemplary embodiment, container 100 extends along a longitudinal axis 102 between a first or top end 104 and a second or bottom end 106.

Container 100 is configured to be selectively moved by a user between the closed or stowed position and an open or dispensing position in order to dispense and/or apply the cosmetic material retained within container 100.

Figure 4:
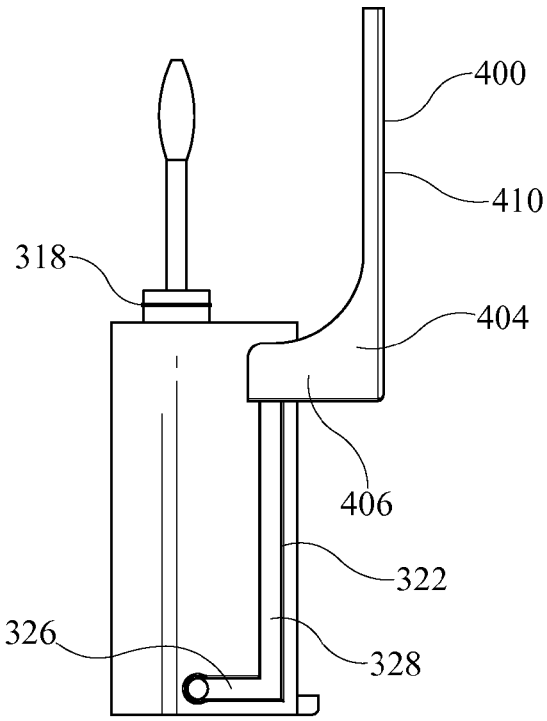
FIG. 4 is a side view of the container of FIG. 1 in an open position with the receptacle not shown.

Applicator 300 is configured to be releasably coupled to receptacle 200 so that receptacle 200 can be selectively moved by a user between a coupled and uncoupled position. Mirrored element 400 is configured to be movably coupled to applicator 300 so mirrored element 400 can be selectively moved by a user between a retracted position and an extended position. Referring to FIG. 1, when container 100 is in the closed position, receptacle 200 is coupled to applicator 300 and mirrored element 400 is in the retracted position. Referring to FIG. 4, when container 100 is in the open position, receptacle 200 is uncoupled from applicator 300 and mirrored element 400 is in the extended position. Accordingly, container 100 can be selectively moved by a user between the closed position and the open position. For purposes of this disclosure, the term coupled is used broadly to mean the joining or combining of two or more members (e.g., portions, materials, components, etc.) directly or indirectly to one another. Such joining or combining may be relatively stationary (e.g., fixed, etc.) in nature or movable (e.g., adjustable, etc.) in nature. Such joining or combining may be achieved with the two members or the two members and any additional intermediate members being integrally formed as a single unitary body with one another (e.g., one-piece, etc.) or with the two members or the two members and any additional intermediate member being attached to one another. Such joining or combining may be intended to be relatively permanent in nature or alternatively may be intended to be relatively detachable or removable in nature.

Figure 2:
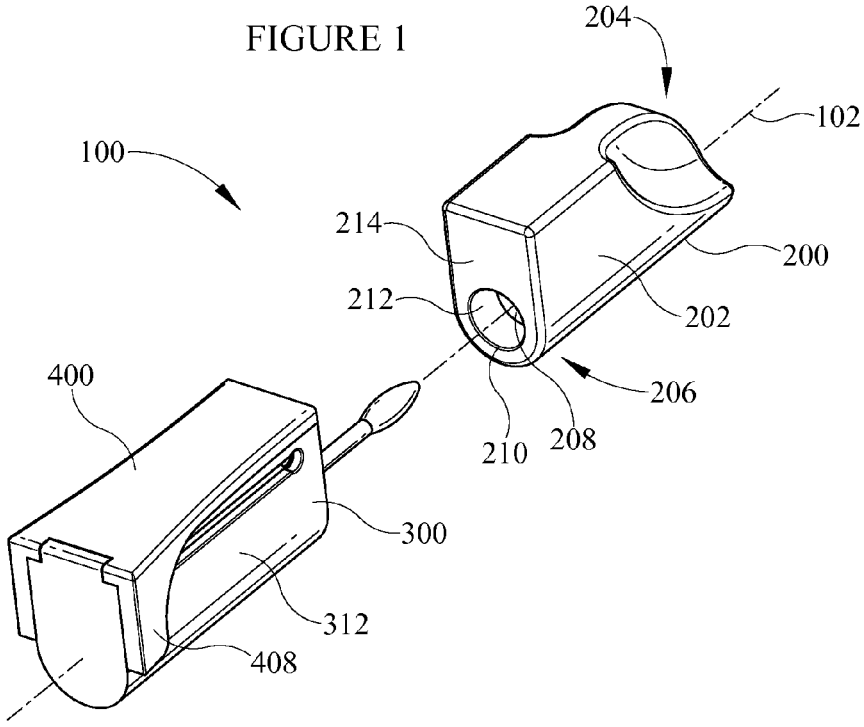
FIG. 2 is a perspective view of the container of FIG. 1 with an uncoupled receptacle.

Referring to FIGS. 1 and 2, receptacle 200 is shown according to an exemplary embodiment. Receptacle 200 generally includes a sidewall portion 202, extending along longitudinal axis 102 (e.g., in a vertical direction, etc.) between a closed first or top end 204 and an open second or bottom end 206. According to the embodiment illustrated, receptacle 200 is formed as a one-piece unitary body, but alternatively, may be formed of two or more sections that are subsequently coupled together. For example, top end 204 and/or bottom end 206 may be a separate section that is subsequently attached to sidewall portion 202.

Sidewall portion 202, top end 204, and bottom end 206 cooperate to define a cavity (e.g., hollow area, storage area, etc.), shown as a chamber 208, that is configured to at least partially receive applicator 300. According to an exemplary embodiment, chamber 208 may also be configured to retain a liquid material, such as mascara. The size and shape of chamber 208 may vary depending on a number of design criteria. According to the various alternative embodiments, chamber 208 may be sized to retain any quantity of a liquid material.

Bottom end 206 is the portion of receptacle 200 that is configured to receive and be coupled to applicator 300. In order to receive applicator, 300, bottom end 206 defines an opening or aperture 210 that is in communication with chamber 208. According to an exemplary embodiment, aperture 210 has a cross sectional shape that substantially corresponds to the cross sectional shape of the portion of applicator 300 that is received within receptacle 200. For example, aperture 210 may be circular (as shown), triangular, elliptical, octagonal, rectangular, or any other shape.

According to the embodiment illustrated, aperture 210 is sized to be slightly larger than an outer periphery of the portion of applicator 300 that is received within receptacle 200 so that there is little or no gap between an inner periphery of top end 204 and the portion of applicator 300 that is received within receptacle 200. Such a configuration may assist in guiding applicator 300 into receptacle 200 when a user is returning container 100 to the closed position. Such a configuration may also allow the overall size (e.g., circumference, diameter, etc.) to be reduced. Such a configuration may further provide a sealing function (e.g., by providing a substantially hermetic or airtight seal between receptacle 200 and applicator 300, etc.). Such a configuration may further remove the liquid material from an outer periphery of applicator 300. To further assist in removing the liquid material from the outer periphery of applicator 300, a wiper element (e.g., gasket, seal, sponge, etc.) may be provided around aperture 210 that is configured to engage the outer periphery of applicator 300 as applicator 300 is being removed from receptacle 200.

To facilitate coupling of applicator 300 to receptacle 200, bottom end 206 of receptacle 200 includes a first retaining or coupling element, shown as internal threads 212 supported on the inside surface of chamber 208, configured to releasably engage a corresponding retaining or coupling element provided on applicator 300. According to various alternative embodiments, the coupling element may be any suitable attachment structure (e.g., press-on rings or snap-fit structure, ribs, friction fit, etc.) for releasably securing receptacle 200 to applicator 300.

According to an exemplary embodiment, bottom end 206 of receptacle 200 includes a bottom surface 214 configured to receive an abutting surface of applicator 300 when container 100 is in the closed position. Bottom surface 214 is shown being substantially perpendicular to sidewall portion 202 (as shown), but alternatively may be provided at any orientation relative to side wall 202. For example, according to the various alternative embodiments, bottom surface may have a curved profile, an angled profile, a stepped profile, or any combination thereof.

According to an exemplary embodiment, receptacle 200 is formed of a moldable material (e.g. plastic, etc.) in a forming process (e.g. injection molding process, etc.) The moldable material (e.g. plastic, etc.) may be provided as a generally transparent material (e.g. clear, tinted, etc.), a generally opaque material (e.g. non-transparent, colored, etc.), or a combination of a transparent material and an opaque material. The moldable material may be suitable moldable plastic or other suitable materials for molding a receptacle. According to the various alternative embodiments, receptacle 200 may be formed of any known or otherwise suitable material capable of providing a substantially rigid structure (e.g., glass, aluminum and/or an aluminum alloy, etc.) Receptacle 200 may be made of anyone of these materials (or other suitable materials) alone or in combination with another material.

Figure 3:
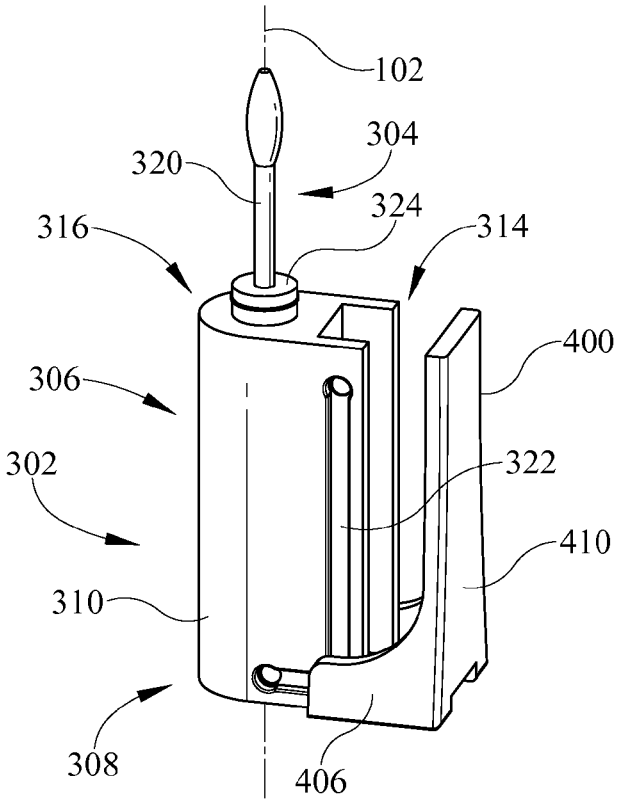
FIG. 3 is a perspective view of the container of FIG. 1 with the receptacle uncoupled and not shown.

Further referring to FIGS. 2-4, applicator 300 is shown according to an exemplary embodiment. Applicator 300 is configured to be removably coupled to bottom end 206 of receptacle 200 so that a user can selectively remove receptacle 200 in order to use applicator 300 to apply and/or dispense the cosmetic material. According to an exemplary embodiment, applicator 300 generally includes a main body portion 302 and an operating element 304. In the embodiment illustrated, main body portion 302 is configured to facilitate the coupling of applicator 300 to receptacle 200. Main body portion 302 includes a top end 306, a bottom end 308, a first side 310, a second side 312, a front end 314, and a back end 316. Operating element 304 is provided for applying the cosmetic material by applicator 300.

To facilitate the coupling of applicator 300 to receptacle 200, main body portion 302 includes a second retaining or coupling element, shown as external threads 318, for engaging the corresponding coupling element (e.g., internal threads 212, etc.) on receptacle 200 to releasably secure applicator 300 to receptacle 200. According to various alternative embodiments, the second coupling element may be any suitable attachment structure (e.g., press-on rings or snap-fit structure, ribs, friction fit, etc.) for releasably securing applicator 300 to receptacle 200.

According to the embodiment illustrated, container 100 is configured to be moved in part from the closed position to the open position by rotating receptacle 200 relative to main body portion 202 in a direction (e.g., counterclockwise, etc.) that disengages internal threads 212 from external threads 318 thereby uncoupling receptacle 200 from applicator 300. One or more friction elements, shown as gripping portion 220, may by provided on an outside surface of receptacle 200 to assist a user in grasping and rotating receptacle 200. In the embodiment illustrated, gripping portion 220 is shown as depressions configured to receive the thumb and forefinger of the user. According to alternative embodiments, gripping portion 220 may be formed in or coupled to receptacle 200 in any manner configured to assist a user in grasping and rotating receptacle 200.

According to an exemplary embodiment, main body portion 302 is formed of a moldable material (e.g. plastic, etc.) in a forming process (e.g. injection molding process, etc.) Like receptacle 200, the moldable material (e.g. plastic, etc.) may be provided as a generally transparent material (e.g. clear, tinted, etc.), a generally opaque material (e.g. non-transparent, colored, etc.), or a combination of a transparent material and an opaque material. The moldable material may be suitable moldable plastic or other suitable materials for molding main body portion 302. According to the various alternative embodiments, main body portion 302 may be formed of any known or otherwise suitable material. Main body portion 302 may be made of anyone of these materials (or other suitable materials) alone or in combination with another material.

Supported at top end 306 of main body portion 302 of applicator 300 is operating element 304 (e.g., applicator, flocked applicator, etc.), shown as a mascara wand 320. The type of operating element 304 provided may vary depending on the intended application of container 100. For example, according to the various alternative embodiments, the operating element may be a preformed swab, sponge applicator, miniature comb, or any other known or otherwise suitable operating element. Operating element 304 extends from main body portion 302 substantially along longitudinal axis 102 toward top end 204 of receptacle portion 200 when container 100 is in the closed position. In the embodiment illustrated, mascara wand 320 is substantially concentrically aligned with a projection 324. External threads 318 are supported by the external surface of projection 324. Projection 324 and chamber 208 are configured to be concentrically aligned with longitudinal axis 102. Projection 324 has a cross-sectional shape that substantially corresponds to the cross-sectional shape of aperture 2210. When receptacle 200 and applicator 300 are coupled, internal threads 212 of receptacle 200 engage external threads 318 of applicator 300 and projection 324 is received in aperture 210.

Main body portion 302 of applicator 300 further includes a third retaining or coupling element, shown as slots 322, for engaging the corresponding retaining or coupling element on mirrored element 400. In the illustrated embodiment, slots 322 are molded into main body portion 302, however, in alternative embodiments slots 322 may be formed by any suitable method, including, but not limited to, being separately molded and later attached to main body portion 302, being cut out, etc.

Referring to FIGS. 1, 3, and 4, one slot is located on the first side 310 of main body portion 302 and the other slot is located on second side 312 of main body portion 302. In the illustrated embodiment, slots 322 each include a horizontal portion 326 substantially perpendicular to longitudinal axis 102 and a vertical portion 328 substantially parallel to longitudinal axis 102. Further horizontal portion 326 on first side 310 is substantially parallel to horizontal portion 326 on second side 312, and vertical portion 328 on first side 310 is substantially parallel to vertical portion 326 on second side 312. The path created by slots 322 is defined by horizontal portions 326 and vertical portions 328. Horizontal portions 326 are located on bottom end 308. Vertical portions 328 are located proximate front end 314. In the illustrated embodiment, vertical portions 328 intersects horizontal portions 326 at the proximate end of horizontal portion 326, i.e., proximate front side 314. The resulting path is L-shaped. In alternative embodiments, the path defined by slots 322 may be curved, may be a combination of a horizontal portion and a curved portion, may be a combination of a vertical portion and a curved portion, may be angled, etc. Further, slots may vary in shape, depth, width, have undercuts, etc.

Referring to FIGS. 2-5, mirrored element 400 is shown according to an exemplary embodiment. Mirrored element 400 is configured to be slidably coupled to applicator 300 so that a user may move mirrored element 400 from the retracted position to the extended position in order to use mirror 402 when applying and/or dispensing the cosmetic material. According to an exemplary embodiment, mirrored element 400 generally includes a mirror 402 and a mirror support structure 404. In the embodiment illustrated, mirror support structure 404 includes a first side 406, a second side 408, and a front side 410. Mirror 402 is secured to the internal surface of front side 410. Mirror 402 may be secured in accordance with any number of methods know in the art. For example, mirror 402 can be secured for to the internal surface of front side 410 with an adhesive.

According to an exemplary embodiment, mirror support structure 404 is formed of a moldable material (e.g. plastic, etc.) in a forming process (e.g. injection molding process, etc.). The moldable material (e.g. plastic, etc.) may be provided as a generally transparent material (e.g. clear, tinted, etc.), a generally opaque material (e.g. non-transparent, colored, etc.), or a combination of a transparent material and an opaque material. The moldable material may be suitable moldable plastic or other suitable materials for molding a receptacle. According to the various alternative embodiments, mirror support structure 404 may be formed of any known or otherwise suitable material capable of providing a substantially rigid structure (e.g., glass, aluminum and/or an aluminum alloy, etc.) mirror support structure 404 may be made of anyone of these materials (or other suitable materials) alone or in combination with another material. According to the embodiment illustrated, mirror support structure 404 is formed as a one-piece unitary body, but alternatively, may be formed of two or more sections that are subsequently coupled together.

To facilitate coupling mirrored element 400 to applicator 300, first side 406 and second side 408 of mirrored element 400 include a fourth retaining or coupling elements 412 for engaging the corresponding retaining or coupling elements (e.g., slots 322, etc.) of applicator 300. Coupling elements 412 are slidable within slots 322, enabling a user to slidably translate mirrored element 400 along the path defined by slots 322 from the retracted position to the extended position. According to various alternative embodiments, coupling elements 412 may be any suitable structure for slidably securing mirrored element 400 to applicator 300. Further, the slot-coupling element system may include features enabling mirrored element 400 to be substantially secured in the retracted position, the extended position, or another desired position.

In the illustrated embodiment, the shape of mirror support structure 304 substantially corresponds in-part to the shape defined by main body portion 302 of applicator 300. Referring to FIG. 1, when container 100 is in the closed position, mirrored element 400 is in the retracted position. When mirrored element 400 is retracted, the internal surfaces of first side 406, second side 408, and front side 410 of mirrored element 400 are substantially aligned with the external surfaces of first side 312, second side 312, and front side 314 of main body portion 302 of applicator 300. In the embodiment illustrated, mirrored element 400 is shown coupled to applicator 300 at the distal end of horizontal portion 326 of slots 322.

Referring to FIG. 3, mirrored element 400 is shown between the retracted position and the extended position. In the illustrated embodiment, mirrored element 400 is shown slidably translated along horizontal portions 326 of slots 322 to the proximate end of horizontal portion s 316, where each horizontal portion 326 and vertical portion 328 intersect. At this location, front side 410 of mirrored portion 400 is moved away from main body portion 302.

Figure 5:
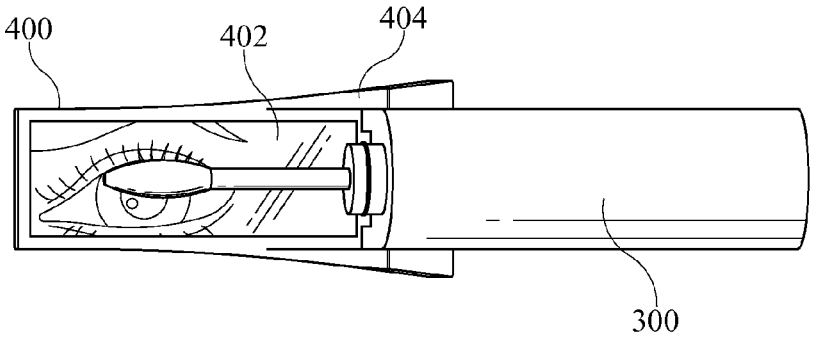
FIG. 5 is a perspective view of the applicator and the mirrored element of the container of FIG. 1 in an open position arid in use for dispensing and/or applying a cosmetic material.
Figure 6:
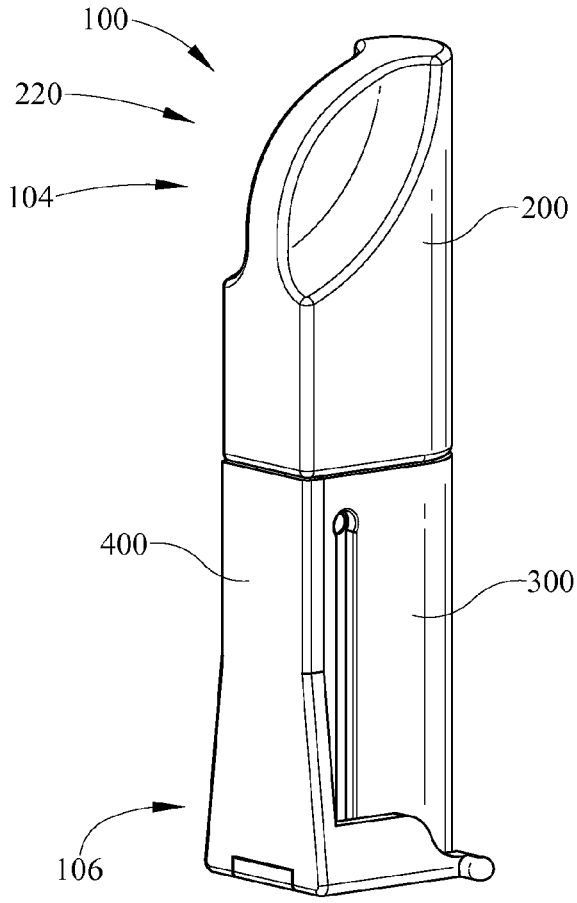
FIG. 6 is a perspective view of an exemplary embodiment of a container in a closed position.
Figure 7:
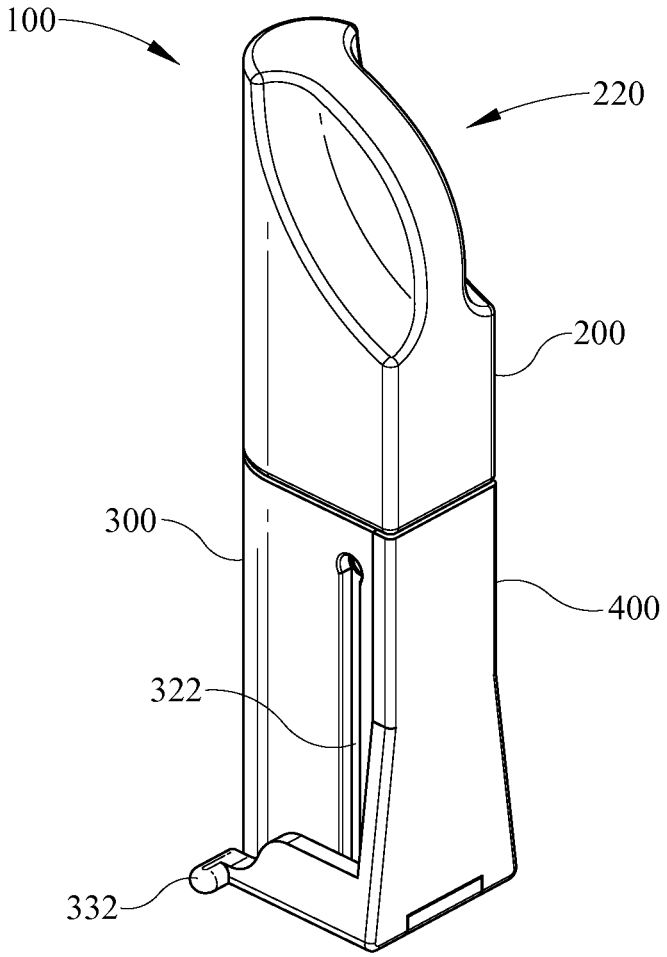
FIG. 7 is a perspective view of the container in FIG. 6 in the closed position.
Figure 8:
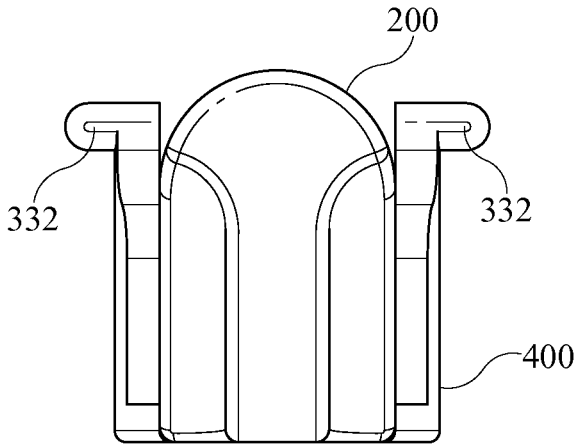
FIG. 8 is a top view of the container in FIG. 6 in the closed position.
Figure 9:
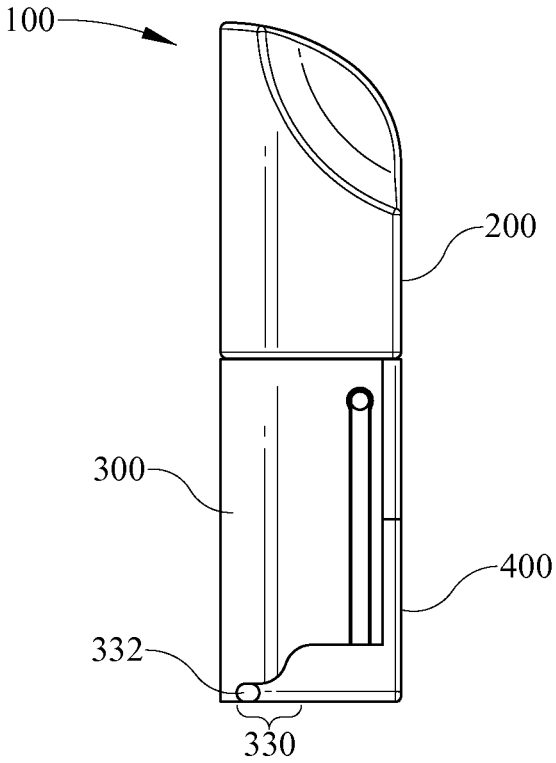
FIG. 9 is a side view of the container in FIG. 6 in the closed position.
Figure 10:
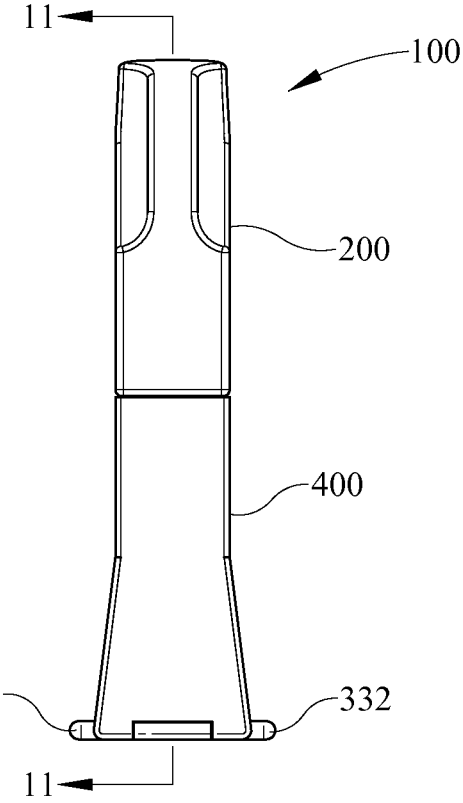
FIG. 10 is a front view of the container in FIG. 6 in the closed position.
Figure 11:
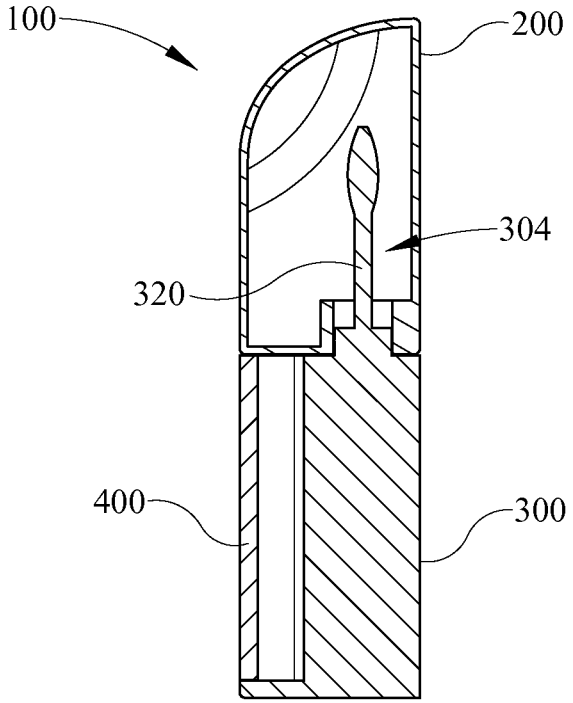
FIG. 11 is a sectional view of the container in FIG. 10 along line A-A.
Figure 12:
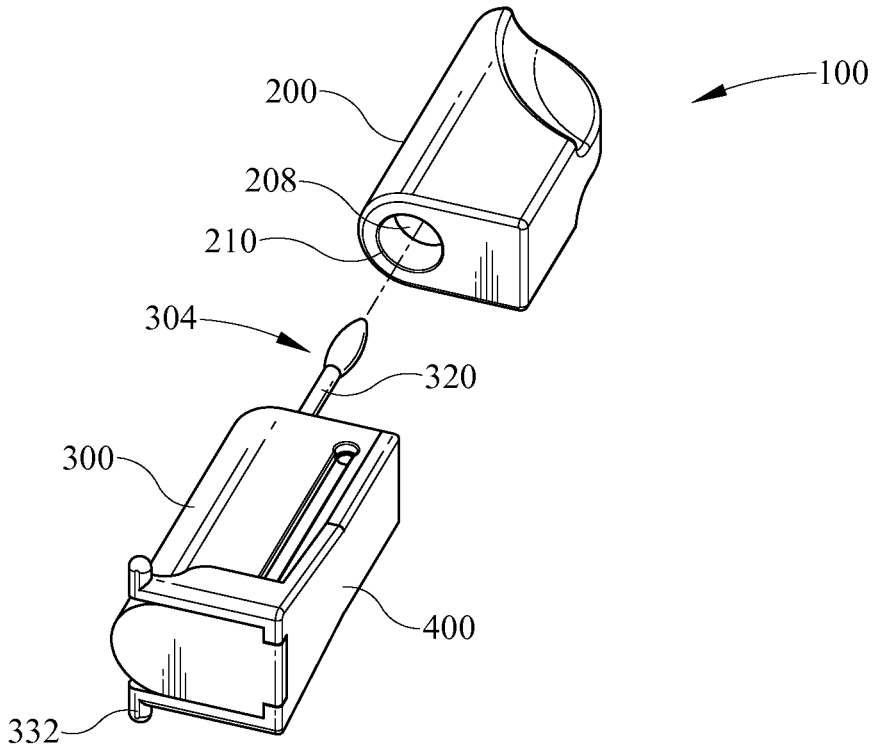
FIG. 12 is a perspective view of the container in FIG. 6 with an uncoupled receptacle.
Figure 13:
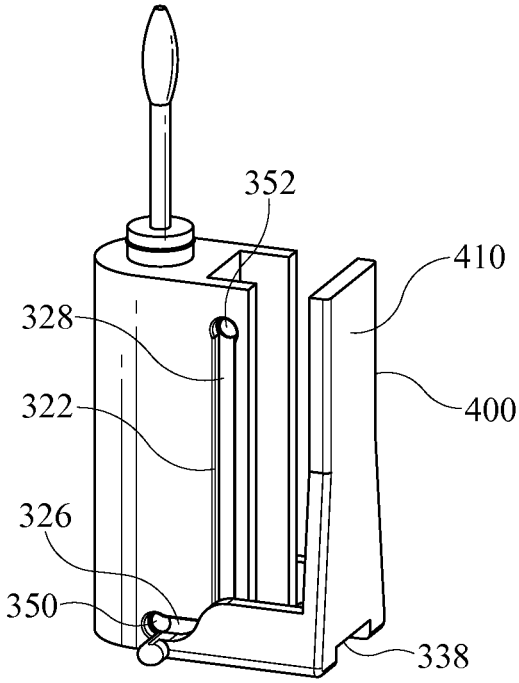
FIG. 13 is a perspective view of the container in FIG. 6 with the receptacle uncoupled and not shown.

Referring to FIG. 4, mirrored element 400 is shown in the extended position. To move mirrored element 400 from the retracted position to the extended position, the user can slidably move mirrored element 400 along the entire path defined by slots 322. In the extended position, mirrored portion 400 is positioned such that the user can view application of a cosmetic material their person. Referring to FIG. 5, in the in-use position mirror 402 is substantially parallel to mascara wand 320 such that during dispensing and/or application of the mascara, the eye of the user, the mascara wand 320, and mirror 402 are substantially aligned. In this manner, the user is able to perform a precise, single handed application of a cosmetic material with improved visibility and without the need for an external mirror.

Another exemplary embodiment is shown in FIGS. 6-16. The embodiment shown in FIGS. 6-16 is substantially similar to the exemplary embodiment shown in FIGS. 1-5 but there are some differences.

Figure 14:
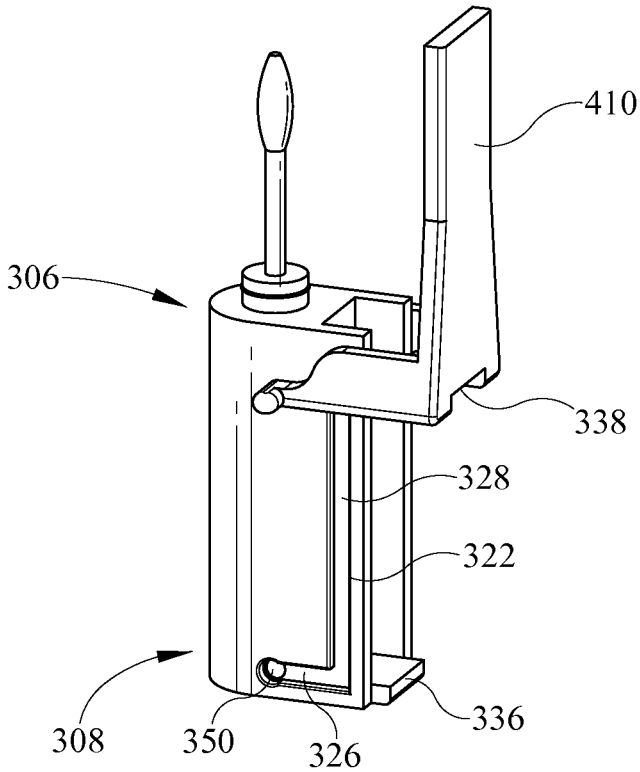
FIG. 14 is a perspective view of the container in FIG. 6 in an open position with the receptacle not shown.
Figure 15:
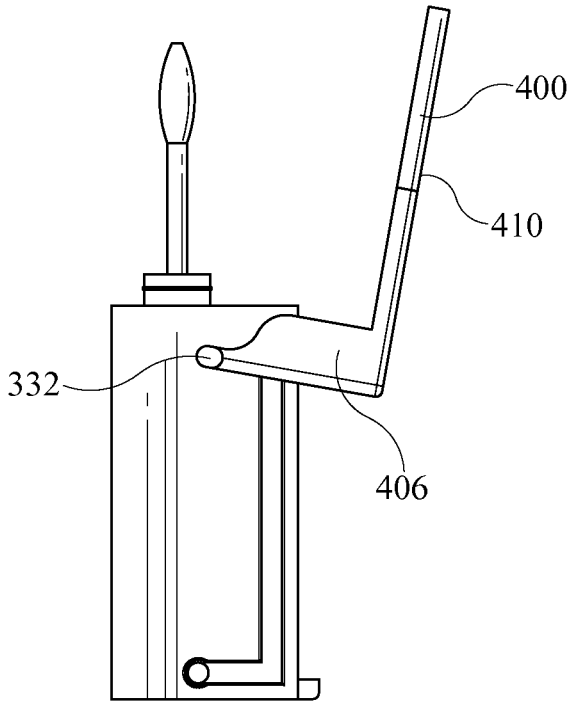
FIG. 15 is a perspective view of the container in FIG. 6 in the open position with the receptacle not shown
Figure 16:
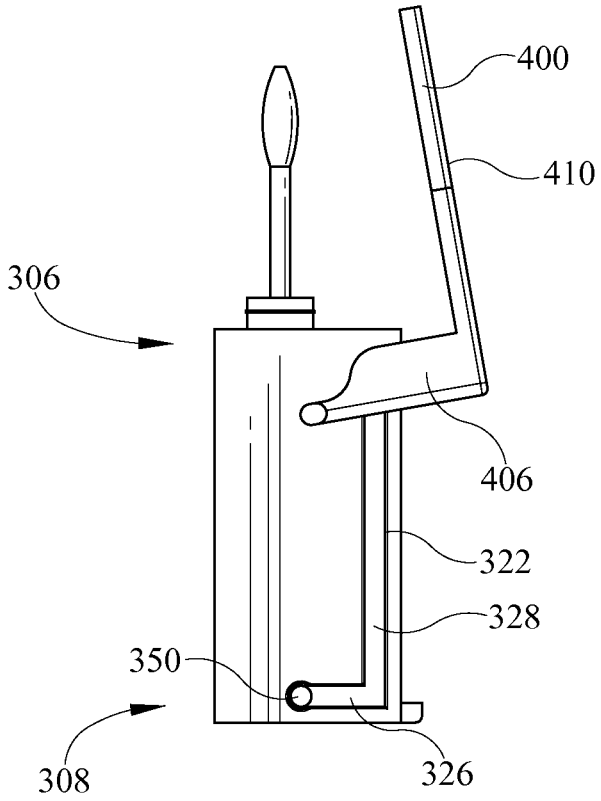
FIG. 16 is a perspective view of the container in FIG. 6 in the open position with the receptacle not shown.

Referring to FIGS. 6-16, the first difference relates to the movement of mirrored element 400. Referring to FIGS. 14-16, coupling elements 412 of mirrored element 400 are configured to enable mirrored element 400 to be pivoted within slots 322 in addition to being slidable. To facilitate pivoting of mirrored element 400, first side 406 and second side 408 of mirrored support element 404 each include a lever arm 330 extending along first side 310 and second side 312 of main body portion 302. Lever arms 330 are substantially defined by the portions of first side 406 and second side 408 extending beyond coupling elements 412 in a direction away from front side 410. Mirrored element protrusions 332 are located at the distal end of each lever arm 330. Referring to FIG. 14, mirrored element 400 is shown in the extended position, unpivoted. When mirrored element 400 is in the extended position, a user may push mirrored element protrusions 332 of lever arms 330 toward bottom end 308 of applicator 300 to move mirror 402 closer to operative member 304 as seen in FIG. 16. When mirrored element 400 is in the extended position, a user may push mirrored element protrusion 332 of lever arms 330 toward top end 306 of applicator 300 to move mirror 402 away from operative member 304. Mirrored element 400 is further capable of being pivoted in positions other than the extended position. In alternative embodiments, mirrored element protrusions 332 may be configured in any manner enabling a user to utilize lever arms 330 to pivot mirrored element 400. further, in other alternative embodiments, any number of methods for pivoting mirrored element 400 may be used.

A second difference relates to the inclusion of securing elements enabling mirrored element 400 to be substantially secured in the retracted position. Referring to FIGS. 13-16, a retracted position securing feature 350 and an extended position securing feature 352 are shown. In the illustrated embodiment, one retracted position securing feature 350 is located at the distal end of each horizontal portion 326. One extended position securing feature 352 is located in each vertical portion 328 toward top end 306. When coupling mechanisms 412 are substantially aligned with retractable position securing features 350, mirrored element 400 is substantially releasably secured in the retracted position. When coupling mechanisms 412 are substantially aligned with extended position securing features 352, mirrored element 400 is substantially releasably secured in the extended position at the angle desired by the user. Securing elements may include, but are not limited to, clips, snaps, pressure seals, etc.

A third difference relates to bottom end 308 of main body portion 302 and of mirrored portion 400. Referring to FIGS. 6-16, bottom end 308 includes a protrusion 336 extending outward from main body portion 302 between first side 310 and second side 312. Front wall 410 of mirrored portion 400 includes an extrusion 338. When mirrored portion 400 is in the retracted position, protrusion 336 fits at least in-part within extrusion 338 and protrusion 336 and extrusion 338 are substantially aligned to create a unified exterior surface of container 100. Further, protrusion 336 and extrusion 338 help align and secure mirrored element 400 with applicator 300. The features shown in FIGS. 6-16 facilitating securing mirrored element 400 in the retracted position are particularly beneficial when container 100 is being transported. For example, when container 100 is in a user's purse, in a user's pants pocket, etc. These features also help prevent undesired openings of container 100, contamination of cosmetic material in container 100, etc.

Another exemplary embodiment is shown in FIGS. 17-21. The embodiment shown in FIGS. 17-21 is substantially similar to the exemplary embodiment shown in FIGS. 1-5 but there are some differences Referring to FIGS. 17-21, the first difference is that receptacle 200 and applicator 300 are shown as a single body 500. Body 500 includes a top end 502 and a bottom end 504. Body 500 may be formed of two or more sections that are subsequently coupled together.

Figure 17:
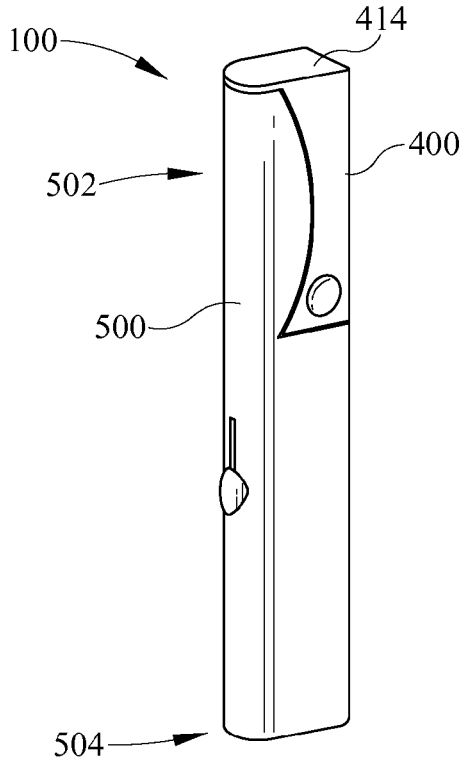
FIG. 17 is a perspective view of an exemplary embodiment of a container in a closed position.
Figure 18:
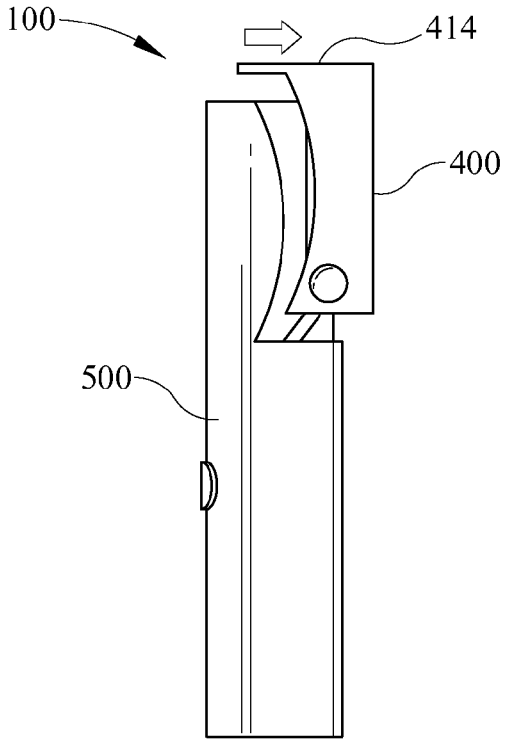
FIG. 18 is a side view of the container in FIG. 17 in an open position.

Further referring to FIGS. 17-21, a third difference is the position of mirrored element 400. In the illustrated embodiment, mirrored element 400 is located at top end 502 of body 500. Referring to FIG. 17, when container 100 is in the closed position, the exterior of mirrored element 400 is substantially flush with the exterior of body 500, creating a unified exterior. In the illustrated embodiment, mirrored element 400 further includes a top side 414. Top side 414 substantially covers the aperture at the top end 502 of body 500 when container 100 is in the closed position. When mirrored element 400 is in the retracted position, the bottom surface of top side 414 abuts the top surface at top end 502 of body 500.

Figure 19:
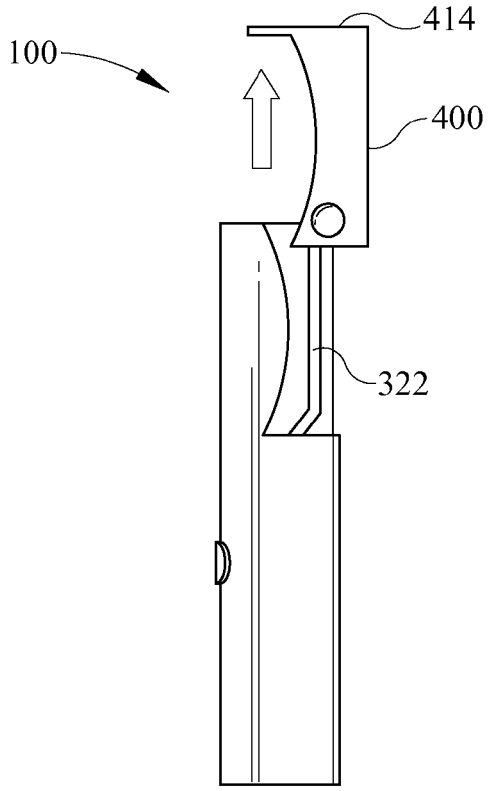
FIG. 19 is a side view of the container in FIG. 17 in an open position.
Figure 20:
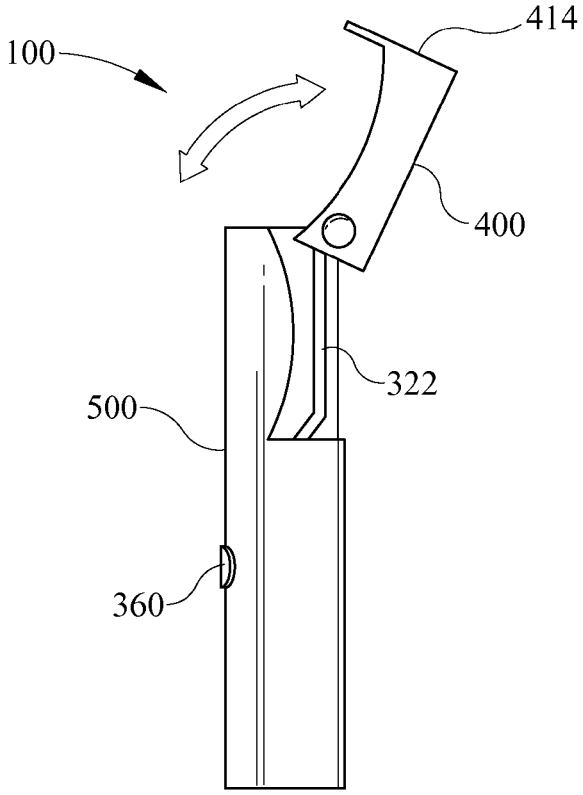
FIG. 20 is a side view of the container in FIG. 17 in an open position
Figure 21:
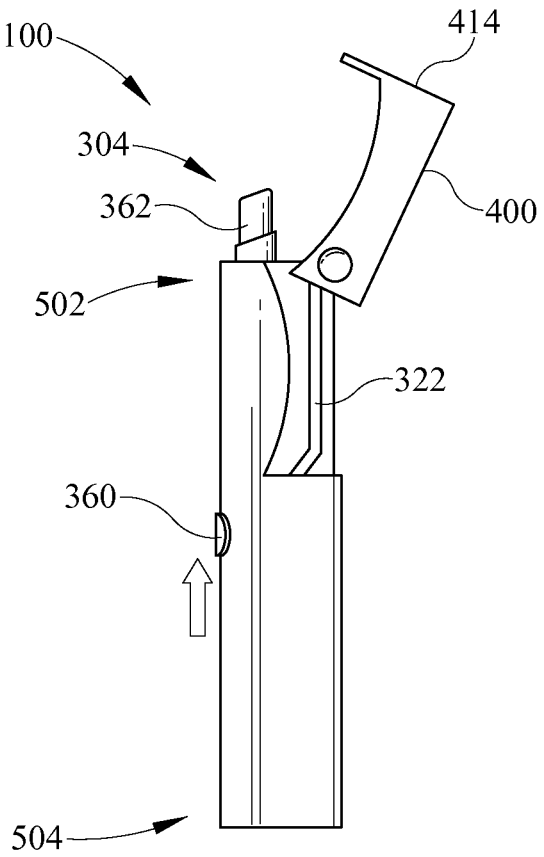
FIG. 21 is a side view of the container in FIG. 17 in an open position with an operating element extended.

As shown in FIGS. 19-21, another difference relates to slots 322. In the illustrated embodiment, slots 322, like mirrored element 400, are located at the top end 502 of body 500. Further, slots 322 are shown to defined a curved path. As shown in FIG. 17-21, when mirrored element 400 is slidably translated from the retracted position to the extended position along the path defined by slots 322, it is first moved substantially away from body 500 and is then moved substantially vertically upward toward top end 502 of body 500. As shown in FIG. 19, mirrored element 400 is in located substantially above the top surface of body 500 when mirrored element 400 is in the extended position. Similar to the exemplary embodiment shown in FIGS. 6-16, coupling mechanisms 412 enable mirrored element 400 to be pivoted in slots 322 addition to being slidable. Referring to FIGS. 20 and 21, a user can push mirrored portion 400 to position mirror 402 at the angle desired for viewing the dispensing and/or application of a cosmetic material.

Referring to FIG. 21, another difference is that body 500 includes a push button 360. Referring to FIGS. 17-21, push button 360 is configured to enable a user to extend and/or retract operative element 304, shown as lipstick 36. In alternative embodiments, any actuating mechanism configured to enable a user to extend and/or retract an operative element may be used.

Figure 22:
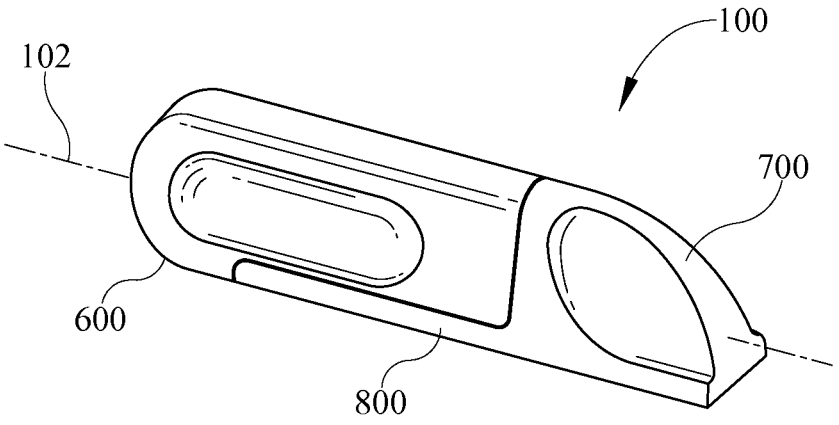
FIG. 22 is a perspective view of an exemplary embodiment of a container in a closed position.

Referring to FIGS. 22-26, another exemplary embodiment of container 100 is shown. In FIG. 22, container 100 is shown a closed or stowed position. Container 100 generally includes a receptacle 600, an applicator 700, and a mirrored element 800 configured to cooperate to provide a conveniently sized storage system suitable for retaining, dispensing, and/or applying liquid material.

Receptacle 600 is substantially similar to receptacle 200 of the exemplary embodiment shown in FIGS. 1-5. Referring to FIGS. 22-26, receptacle 600 generally includes a bottom surface 602, a closed first or top end 604, an open second or bottom end 606, a cavity, shown as a chamber 608, an opening or aperture 610, and a first side 612. In the illustrated embodiment, receptacle 600 and applicator 700 are configured to be releasably coupled so that receptacle 600 can be selectively moved by a user between a coupled and uncoupled position.

Further referring to FIGS. 22-26, applicator 700 and mirrored element 800 are shown fixed relative to one another. Applicator 700 generally includes a main body portion 702 and an operating element 704. Mirrored element 800 includes a mirror 802 and a mirror support structure 804. In the illustrated embodiment, main body portion 702 and mirror support structure 804 are shown formed as a one-piece unitary body, but alternatively, maybe formed of two or more sections that are subsequently coupled together.

Mirror support structure 804 extends substantially parallel to longitudinal axis 102 from main body portion 702 toward top end 604 of receptacle 600. In the illustrated embodiment, mirror support structure 804 is shaped substantially like a rectangular prism having a rectangular cross section. Mirror support structure 804 includes a first or internal side 806 and a second or external side 808. Mirror 804 is secured to first side 806.

Referring to FIG. 22, when container 100 is in the closed position, receptacle 600 is further configured to receive mirror support structure 804. As shown in the illustrated embodiment, the surface of first side 806 of mirror support structure 804 is configured to substantially align with an abutting surface, bottom surface 602, of receptacle 600. Further, receptacle 600 includes mirrored element coupling portion, shown as a recess 614, configured to receive the corresponding portion of mirrored element 800, releasably securing mirror 604 along first side 612 of receptacle 600, thus facilitating storing the mirror when it is not in use and holding it in place.

Figure 23:
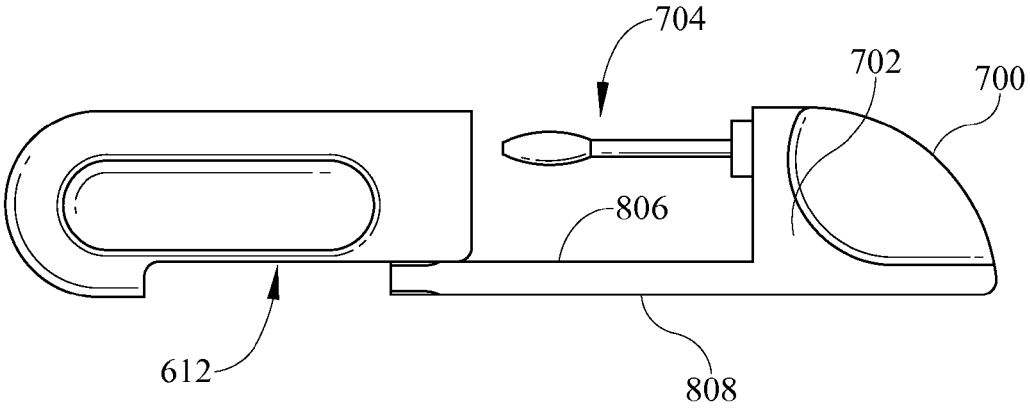
FIG. 23 is a side view of the container in FIG. 22 with the receptacle in-part separated from the applicator and mirrored element.
Figure 24:
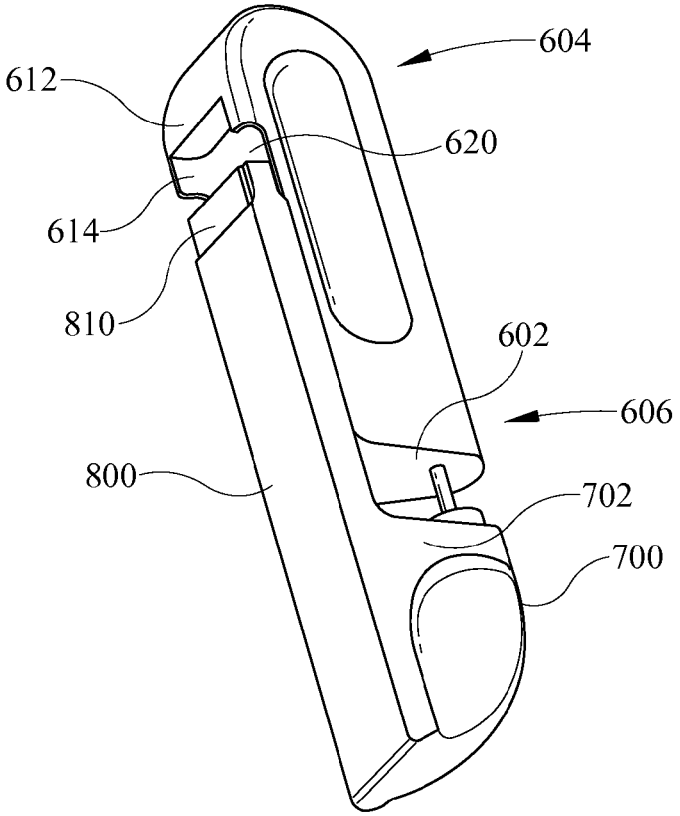
FIG. 24 is a perspective view of the container in FIG. 22 with the receptacle in-part separated from the applicator and mirrored element.

Referring to FIGS. 23 and 24, Mirror support structure 804 includes a protrusion 810 configured to be received in mirrored element coupling portion (e.g., recess 614, etc.). Referring back to FIG. 22, protrusion 810 is received in recess 614 when container 100 is in the closed position. In alternative embodiments, mirrored element coupling portion and the corresponding portion of mirrored element 800 may be of any configuration suitable to properly align and secure mirrored element 800 along first side 612 of receptacle 600. Further, in other alternative embodiments, protrusion 810 and recess 614 may be any of a variety of shapes so long as recess 614 is configured to receive protrusion 810.

Figure 25:
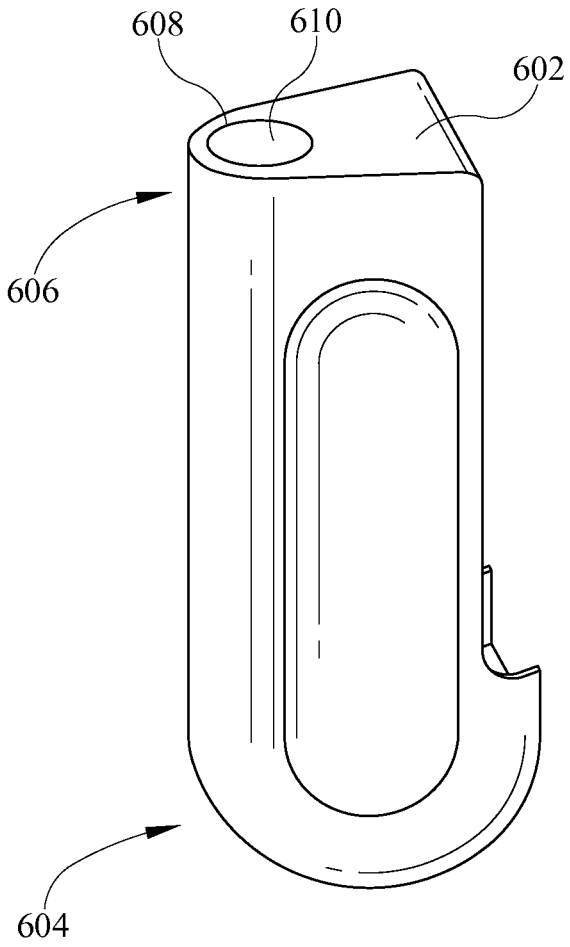
FIG. 25 is a perspective view of the receptacle of the container in FIG. 22.

Referring to FIGS. 23-24, a user may uncouple receptacle 600 from applicator 700 and mirrored element 800 by pulling receptacle 600 away from applicator 700 and mirrored element 800 along longitudinal axis 102 and/or by pulling applicator 700 and mirrored element 800 away from receptacle 600 along longitudinal axis 102. Referring to FIG. 25, receptacle 600 is shown uncoupled and removed from the applicator 700 and mirrored element 800. Gripping elements similar to those discussed above may facilitate this action. A user may couple receptacle 600 with applicator 700 and mirrored element 800 by aligning and pressing receptacle 600 together with applicator 700 and mirrored element 800. In the illustrated embodiment, when a user is moving container 100 from the open position to the closed position, receptacle 600 is properly aligned with applicator 700 and mirrored element 800 when operating element 704 is received in cavity 608, protrusion 810 is received in recess 614, and mirrored support element 804 is substantially secured alongside receptacle 600.

Figure 26:
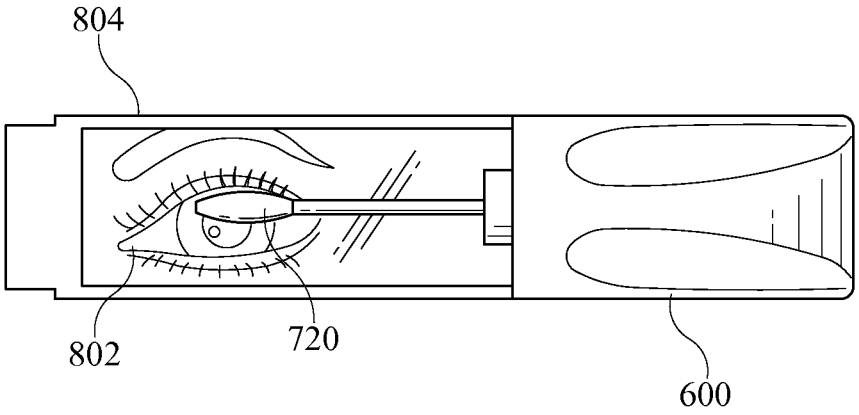
FIG. 26 is a perspective view of the applicator and mirrored element of the container of FIG. 22 in an open position and in use for dispensing and/or applying a cosmetic material.

Referring to FIGS. 25 and 26, once applicator 700 has been removed from cavity 608, the user is able to begin dispensing and/or applying cosmetic material. The position of operating element 704 is fixed relative to mirror 802, thus, mirror 802 requires no positioning. In the illustrated embodiment, operating element 704 of applicator 700 is shown as a mascara wand 720. The user can align their eye with the operating element 704 and the mirror 802 to begin application. In this manner, the user is able to perform a precise, single handed application of a cosmetic material with improved visibility and without the need for an external mirror.

It is important to note that the construction and arrangement of the elements of the container as shown in the exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, the rotational direction to open the container and/or release the liquid material retained within the main body portion may be the same or different. Further, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the appended claims.

I claim:

1. A cosmetic container for retaining and dispensing a cosmetic material, the container comprising:

a first portion including an applicator;

a second portion having a chamber configured to retain a cosmetic material, said second portion releasably coupled to said first portion and configured to move between a first position in which said applicator is exposed and said chamber is open and a second position in which said applicator is concealed and said chamber is closed; and a mirrored element coupled to said first portion, said mirrored element having an internal side, wherein said internal side includes a mirror, said mirrored element being positionable behind said exposed applicator with said mirror of said mirrored element internal side inwardly facing toward said applicator when said second portion is moved to said first position to assist a user in applying said cosmetic material.

2. The cosmetic container of claim 1 wherein said mirrored element is movably coupled to said first portion.

3. The cosmetic container of claim 2 wherein said mirrored element is slidable relative to said first portion between a stowed position and a use position.

4. The cosmetic container of claim 3 wherein said mirrored element is rotatable relative to said first portion when in said use position.

5. The cosmetic container of claim 2 wherein said first portion includes one of a slot and a projection and said mirrored element includes the other of said slot and said projection, said projection engaging said slot for movably coupling said mirrored element to said first portion.

6. The cosmetic container of claim 5 wherein said slot extends in both a horizontal direction and a vertical direction.

7. The cosmetic container of claim 6 wherein said slot is a curved slot.

8. The cosmetic container of claim 6 wherein said slot includes a first segment extending in said horizontal direction and a second segment extending in said vertical direction.

9. The cosmetic container of claim 2 wherein said mirrored element at least partially defines an outer periphery of said container when said mirrored element is in said stowed position.

10. The cosmetic container of claim 2 wherein said mirrored element includes a control arm for adjusting the position of said mirrored element.

11. The cosmetic container of claim 1 wherein said mirrored element is fixedly coupled to said first portion.

12. The cosmetic container of claim 1 wherein said applicator includes a wand and an operating tip, said mirrored element being positionable behind said operating tip.

13. The cosmetic container of claim 1 wherein said chamber is configured to support a liquid material.

14. A cosmetic container for retaining and dispensing a cosmetic material, the container comprising:

a first portion including an applicator;

a second portion having a chamber configured to retain a cosmetic material, said second portion releasably coupled to said first portion and configured to move between a detached position from said first portion in which said applicator is exposed and an attached position with said first portion in which said applicator is concealed; and a mirrored element connected to said first portion by a joint mechanism, said joint mechanism permitting rotational and translational movement of said mirrored element from a closed position to an open position relative to said first portion.

15. The cosmetic container of claim 14 wherein said joint mechanism is a pin-in-slot mechanism.

16. The cosmetic container of claim 15 wherein said pin-in-slot mechanism includes said first portion having at least one slot positioned in at least one direction, wherein said at least one direction is along a longitudinal axis of said container.

17. A cosmetic container for retaining and dispensing a cosmetic material, the container comprising:

a first portion including an applicator;

a second portion includes a chamber configured to retain a cosmetic material, said second portion releasably coupled to said first portion and configured to move between a first position in which said applicator is exposed from said chamber and a second position in which said applicator is concealed in said chamber; and a mirrored element coupled to said first portion, said mirrored element is translationally movable relative to said first portion between a retracted position with said first portion and an extended position to assist a user in applying a cosmetic material.

18. The cosmetic container of claim 17 wherein said mirrored element is rotatable and translational relative to said first portion.

* * * * *